US007819071B2

(12) United States Patent
Seminatore

(10) Patent No.: US 7,819,071 B2
(45) Date of Patent: Oct. 26, 2010

(54) NOZZLE SYSTEM

(76) Inventor: Salvatore J. Seminatore, 132 Oak Hill Cir., Concord, MA (US) 01742

( * ) Notice: Subject to any disclaimer, the term of this patent is extended or adjusted under 35 U.S.C. 154(b) by 130 days.

(21) Appl. No.: 11/978,299

(22) Filed: Oct. 29, 2007

(65) Prior Publication Data

US 2008/0127868 A1 Jun. 5, 2008

Related U.S. Application Data

(60) Provisional application No. 60/859,418, filed on Nov. 16, 2006.

(51) Int. Cl.
*F23G 5/30* (2006.01)

(52) U.S. Cl. ..... 110/245; 110/313

(58) Field of Classification Search ..... 110/245, 110/309, 310, 311, 313; 431/7, 170; 432/58; 406/157; 239/499, 500, 600; 34/369; 261/114.2
See application file for complete search history.

(56) References Cited

U.S. PATENT DOCUMENTS 2,378,952 A * 6/1945 Rousseau ..... 261/114.2
2,797,907 A * 7/1957 De Bie Piet ..... 261/114.2
3,040,439 A 6/1962 Frost
3,498,462 A 3/1970 Larrowe et al.
3,672,577 A 6/1972 Kramer
3,708,887 A 1/1973 Erisman
4,059,877 A * 11/1977 Powers ..... 29/428
4,309,948 A 1/1982 Zielinski
4,387,667 A 6/1983 Goodstine et al.
4,427,375 A * 1/1984 Di Rosa ..... 432/58
4,429,471 A 2/1984 Goodstine et al.
4,524,716 A 6/1985 Mueller
4,526,111 A 7/1985 Mischke
4,574,496 A * 3/1986 Sedlacek ..... 34/585
4,656,971 A 4/1987 Eaton et al.
4,660,768 A * 4/1987 Bunthoff et al. ..... 239/423
4,748,916 A 6/1988 Nordh
4,779,547 A 10/1988 Zügner
4,966,101 A * 10/1990 Maeda et al. ..... 122/4 D (Continued)

FOREIGN PATENT DOCUMENTS

JP 3199809 8/1991

(Continued)

OTHER PUBLICATIONS

Written Opinion, International Searching Authority, International Application No. PCT/US2008/012043, 5 pages, unnumbered.

*Primary Examiner*—Kenneth B Rinehart
*Assistant Examiner*—David J Laux
(74) *Attorney, Agent, or Firm*—Iandiorio Teska & Coleman

(57) ABSTRACT

A nozzle system for a fluidized bed including a pipe for insertion through an air distributor plate in the fluidized bed and extending up through a refractory material on the air distributor plate. A shaft is received in the pipe and has a washer and a collar which supports the shaft on the distal end of the pipe. A cap includes a top surface supported by a skirt, defining a protected annular exhaust space between the shaft and the cap skirt. Spaced discreet supports extend inwardly from the cap skirt supporting and centering the cap on the shaft.

8 Claims, 5 Drawing Sheets

U.S. PATENT DOCUMENTS 5,010,830 A 4/1991 Asuka et al.
5,245,936 A 9/1993 Nakata
5,391,356 A 2/1995 Thorman
5,575,086 A 11/1996 Hartman et al.
6,868,795 B2 3/2005 Maryamchik et al.

FOREIGN PATENT DOCUMENTS

JP 5296428 11/1993

* cited by examiner

NOZZLE SYSTEM

RELATED APPLICATIONS

This application claims benefit of and priority to U.S. Provisional Application Ser. No. 60/859,418, filed Nov. 16, 2006 incorporated herein by this reference.

FIELD OF THE INVENTION

This invention relates to a nozzle system useful in connection with a fluidized bed which may be a component of a solid waste incinerator, a solid or liquid waste incinerator, a coal fired electrical generator, a calciner, or other systems using a fluidized bed.

BACKGROUND OF THE INVENTION

Fluidized beds are often used in municipal solid waste incinerators. The typical fluidized bed incinerator includes several hundred air distributor nozzles located at the bottom of the bed and welded to an air distribution plate. This plate normally has a layer of high temperature refractory material on it and silica sand serving as a fluidizing medium. The typical nozzle is mushroom shaped with numerous drilled holes in the top surface thereof.

The fluidized sand, every time the incinerator is shut down, tends to lodge inside the drilled holes. Then, at the restart of the incinerator, there is a pressure rise in the plenum of the bed as well as uneven fluidization and, with time, even distortion of the air distributor plate. This condition may force a shut down of the solid waste incinerator. The inventor hereof discovered that this phenomenon occurs because, after every shutdown, the air in the plenum of the bed cools faster than the sand above the air distribution plate that holds the nozzles. The hydraulic pressure of the sand in the bed is greater than the pressure in the plenum, and this phenomenon sucks the sand into the holes of the mushroom shaped nozzles plugging them.

Unplugging all of the holes, one by one with carbide drills, involves a lengthy and labor intensive and thus expensive shutdown of the solid waste incinerator. The typical shutdown process includes a cool down time, the removal of all the sand from the bed, the manpower required to drill each hole in all the nozzles (a process often taking days as there are approximately 19,000⅛ inch holes in a 12 foot diameter incinerator), reloading the sand, and start up of the incinerator. Depending upon the frequency of scheduled incinerator shutdowns, plugging of the nozzle holes can force an unscheduled maintenance every three or four months.

BRIEF SUMMARY OF THE INVENTION

It is therefore an object of this invention to provide a new nozzle system for fluidized beds.

It is a further object of this invention to provide such a nozzle system which is less likely to plug.

It is a further object of this invention to provide such a nozzle system which does not require a nozzle welded to the plate and is therefore easier to repair and/or replace.

It is a further object of this invention to provide such a nozzle system wherein it is self-evident if a nozzle is burned or damaged.

The subject invention results from the realization that a better nozzle system for a fluidized bed includes a cap on a shaft with a protected annular exist space which is more easily cleared should material such as the fluidized medium (e.g. sand) enter the annular space when hot air in the shaft is redirected downward by the cap.

This subject invention features a nozzle system including a pipe for insertion through an air distributor plate in a fluidized bed and extending up through a refractory material on the air distributor plate. A shaft is received in the pipe and has a stop which supports the shaft on the distal end of the pipe. A cap includes a top surface supported by a skirt. The inner diameter of the skirt is larger than the outer diameter of the shaft defining a protected annular exhaust space between the shaft and the cap skirt. There are spaced discreet supports extending inwardly from the cap skirt supporting the cap on the shaft. A rod extends within the pipe and the shaft up through an opening in the top surface of the cap. A fastener on the distal end of the rod is urged against the top of the cap and a handle on the proximal end of the rod spans the proximal end of the stand-pipe.

One nozzle system in accordance with the subject invention includes a pipe for insertion through an air distributor plate in a fluidized bed and extending up through a refractory material on the air distributor plate. A shaft is received in the pipe and supported on the distal end of the pipe. A cap having a skirt defines a protected annular exhaust space between the shaft and the cap skirt. Spaced discreet supports support the cap on the shaft. A fastener subsystem secures the cap to the shaft.

One fastener subsystem includes a rod extending within the pipe and the shaft up through an opening in the top surface of the cap. A nut on the distal end of the rod urged against the top of the cap, and a handle on the proximal end of the rod spans the proximal end of the pipe.

The subject invention also features a method of installing nozzles in a fluidized bed with refractory material on an air distributor plate thereof. The method includes installing a stand-pipe through the air distributor plate extending upward therefrom, plugging the proximal end of each pipe, placing malleable refractory material on the air distributor plate, removing plugs when refractory is cured, placing a shaft in each pipe with a washer on a stop which supports the shaft on the distal end of the pipe, placing a cap on each shaft defining a protectoral annular exhaust space between the cap and the shaft, and securing each cap to its shaft and each shaft to its stand-pipe. Securing includes inserting a rod through each pipe, shaft, and cap; placing a fastener on the distal end of the rod against the cap; and turning the rod. Each rod preferably has a T-handle spanning the proximal end of its stand-pipe.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
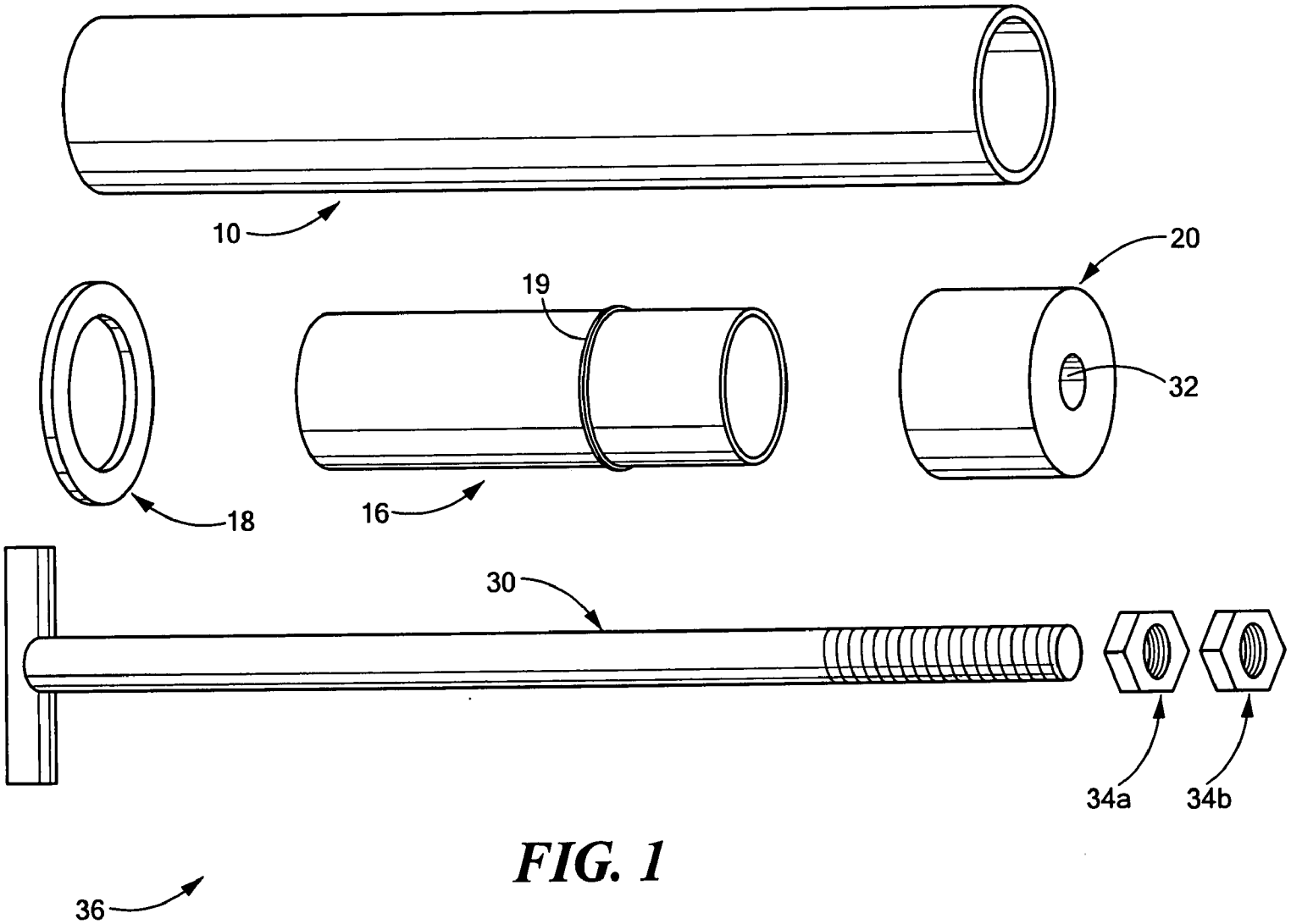
FIG. 1 is a schematic three-dimensional view showing the primary components associated with an example of a nozzle system in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
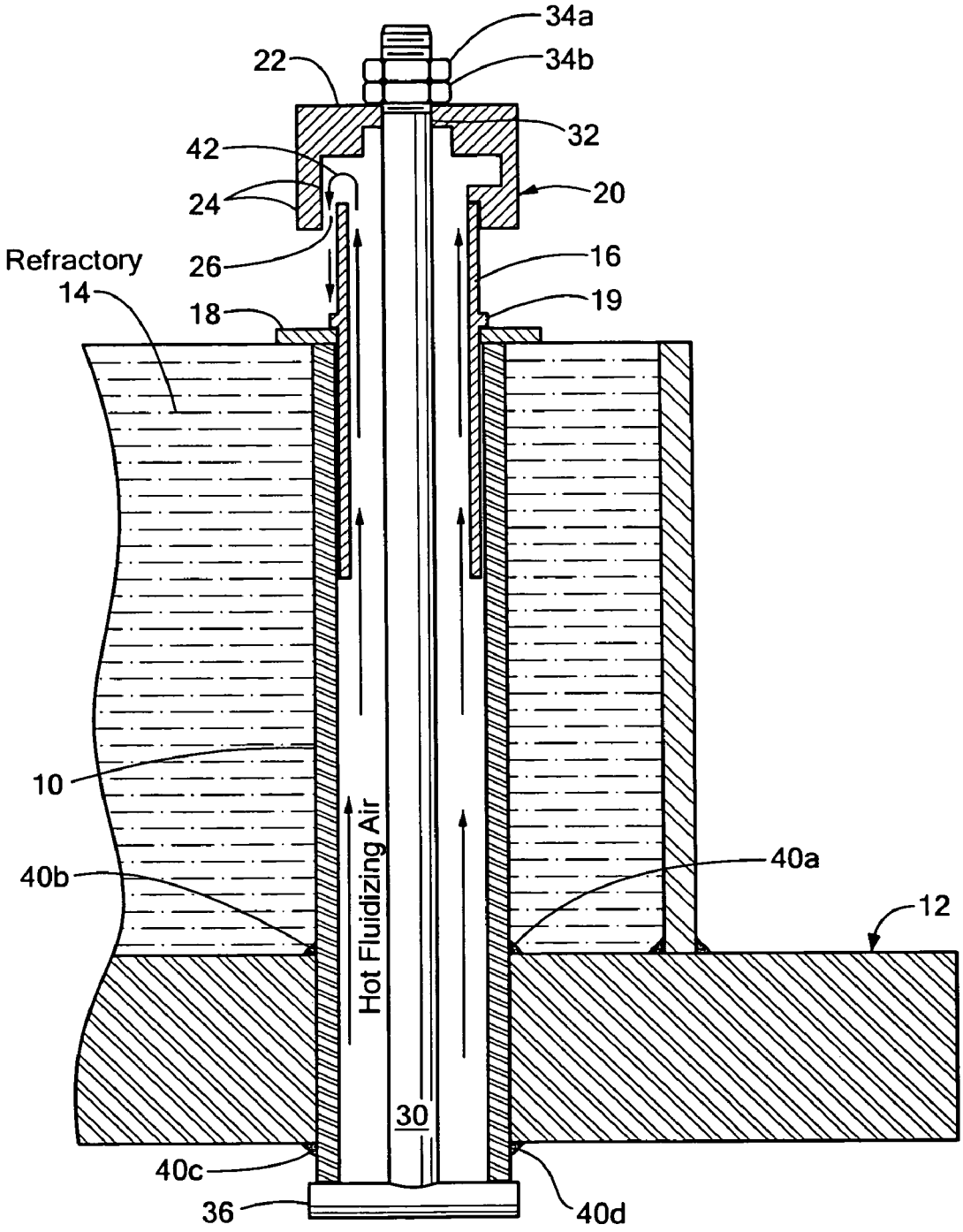
FIG. 2 is a schematic cross-sectional side view showing the components of a nozzle system of the subject invention shown in FIG. 1 in place in a fluidized bed.

FIGS. 1-2 show the primary components associated with an exemplary nozzle system in accordance with the subject invention. Stand pipe 10 is inserted through air distribution plate 12 in a fluidized bed and extends up through refractory material 14 on distributor plate 12 as shown in FIG. 2. The fluidizing medium (e.g. sand) is not shown in FIG. 2. Shaft 16, FIG. 1 is received in pipe 10 as shown in FIG. 2 and includes a stop such as washer 18 on collar 19 which supports shaft 16 on the distal end of pipe 10. Cap 20, FIG. 3 includes top surface 22, FIG. 2 supported by integral skirt 24. The inner diameter of skit 24 is larger than the outer diameter of shaft 16 defining a protected annular exhaust space 26 between the outer diameter of shaft 16 and the inner diameter of skirt 24.

Figure 3:
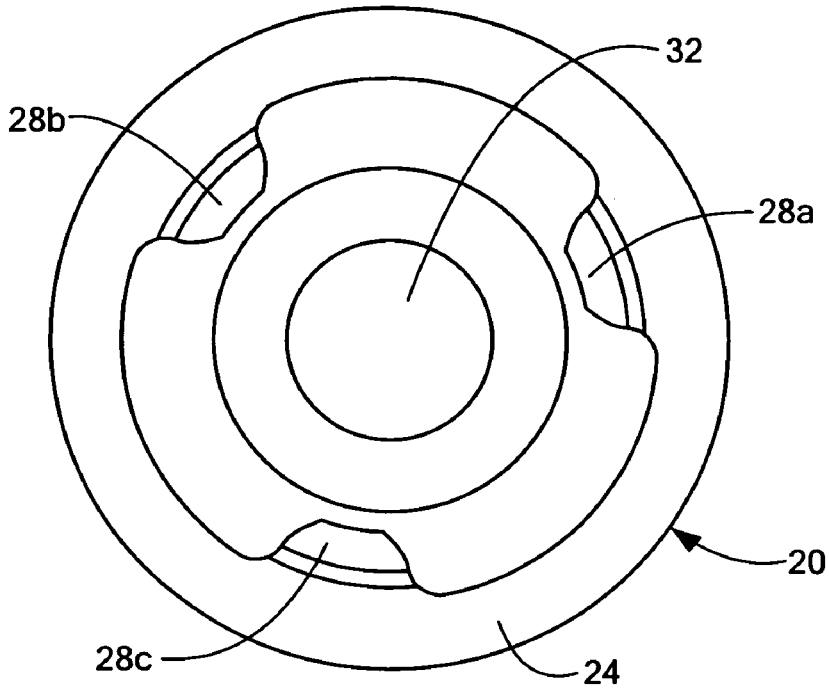
FIG. 3 is a schematic three-dimensional bottom view showing an example of a nozzle system cap in accordance with the subject invention.
Figure 4:
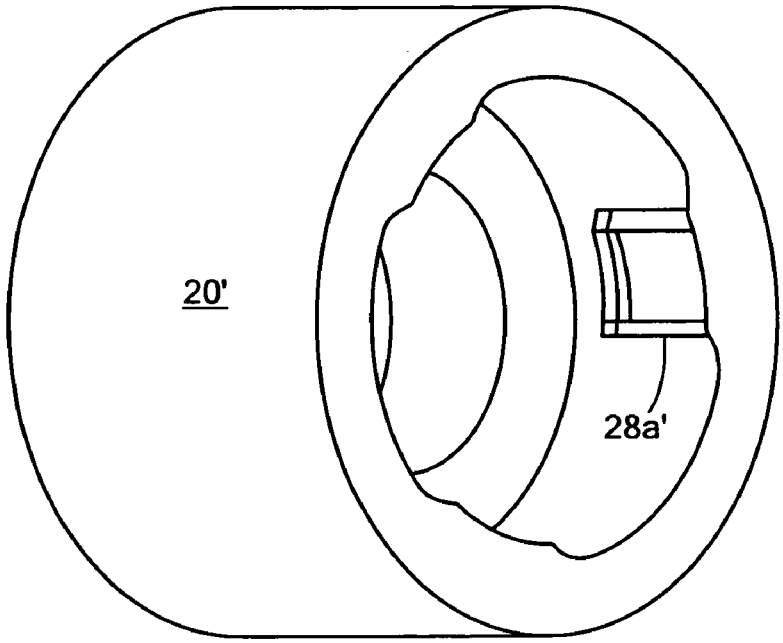
FIG. 4 is a schematic three-dimensional end view showing another example of a nozzle system cap in accordance with the subject invention.

Supports such as spaced discreet supports 28*a*-28*c*, FIG. 3 extend inwardly from the inner diameter of cap skirt 24 and serve to support and center cap 20 on the distal end of shaft 16 as shown in FIG. 2. A fastener subsystem such as rod 30, FIG. 1 extends up through pipe 10 and shaft 16 and through opening 32 in cap top surface 22 as shown in FIG. 2. The distal end of rod 30 includes threads as shown and one or more nuts 34*a*, 34*b* are secured thereto. T-handle 36 on the proximal end of rod 30 spans the proximal end of pipe 10 and can be turned to secure cap 20 on the distal end of shaft 16 and to secure shaft 16 to pipe 10. FIG. 4 shows another embodiment of cap 20' with spaced supports such as inwardly extending support 28*a'*.

Figure 5:
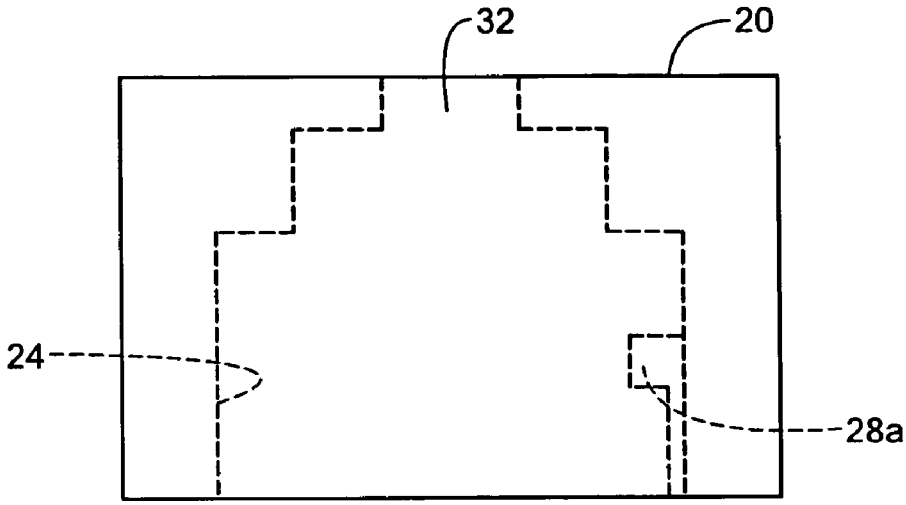
FIG. 5 is a schematic cross sectional view of the nozzle system cap shown in FIG. 4.
Figure 6:
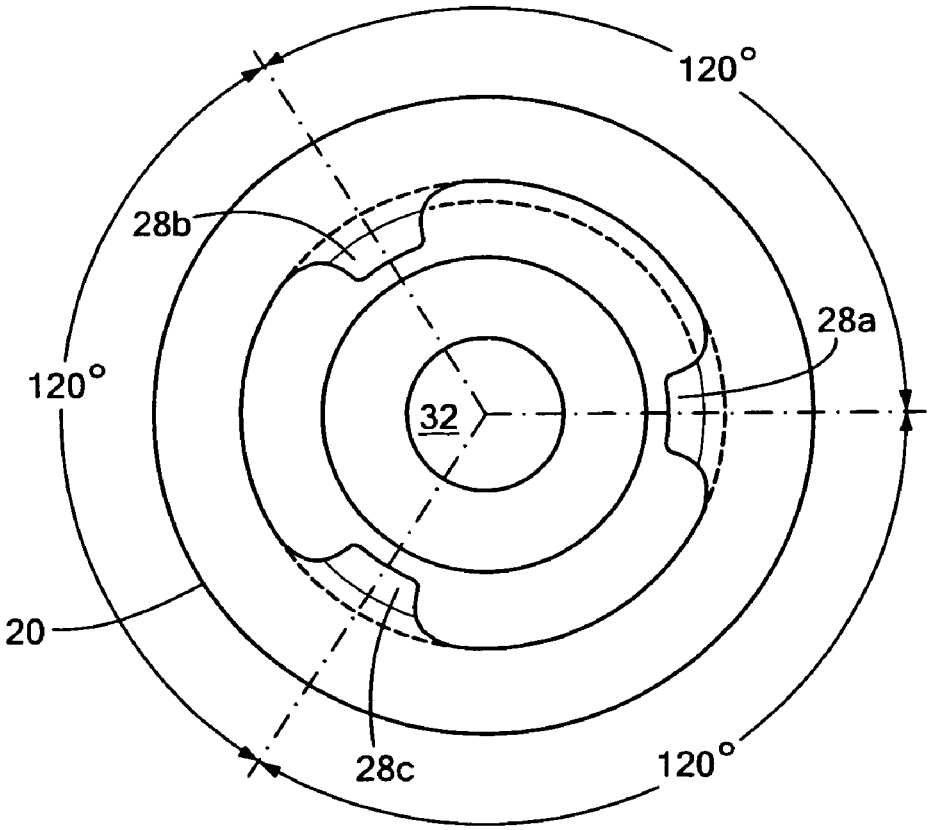
FIG. 6 is a bottom view of the cap shown in FIGS. 4-5.

In one particular example, pipe 10, FIG. 2 is a one inch standard weight (316 S.S.) pipe with a 1.049 inch inner diameter and a 1.315 inch outer diameter. Shaft 16 is a standard ¾ inch pipe or tubing (316 S.S.) with a 1.050 outer diameter. Skirt section 24 of end cap 20 has an inner diameter of 1.160 inches. All of the components are typically made of stainless steel. Through hole 32 in the top surface 22 of cap 20 is typically 7/16 inch in diameter. The ⅜ inch diameter rod 30 is typically 2½ inches longer than pipe 10. T-shaped handle 36 is 1½ inches in length. Inwardly extending equally spaced supports 28*a*-28*c*, FIG. 3, are formed as shown in FIGS. 5-6. The outer diameter of cap 20 is 1.500 inches and cap 20 is 1.00 inches tall. Skirt 24, without the three inner supports, has an inside diameter of 1.160+/−0.002 inches for a depth of 0.625 inch. Then the diameter transitions + to 0.750 inch for depth of 0.250 inch below the through hole 32. The three supports 28*a*-28*c* extend from the inside bottom of skirt 24 0.375 inch and are machined with a radius of 0.525+/−0.002 inch for a depth of 0.250 inch starting from the bottom of the skirt. This machining fixes the throat and depth of the annular space between the cap skirt and the shaft 16, and establishes a particular pressure drop through the nozzle. Cap 20 may be one piece 316 S.S. machined from a 1½ inch diameter rod or machined from a cast to meet the dimensions of the outer diameter of ¾ inch S.S. pipe or tubing.

In operation, all of the stand pipes are welded to air distributor plate 12, FIG. 1 as shown at 40*a*, 40*b*, and 40*c*, and 40*d* (40*c* and 40*d* represent all around continuous weld). The proximal end of each pipe 10 is then plugged with a cork or rubber stopper. The refractory material 14 is then placed on air distributor plate 12 and cured. The rubber stoppers are removed and the various shafts 16 are inserted into their respective pipes. The respective nozzle system end caps are then placed on the shafts. The rods 30 are then inserted from beneath distributor plate 12, the nuts 34*a* and 34*b* are threaded onto the distal ends of the rods 30, and the T-shaped handle 36 of each rod is turned until each nozzle end cap 20 is secured to its respective shaft 16.

If an end cap fails, typically the nut(s) on the rod will burn off and the rod will drop down. That particular pipe can then be plugged from beneath air distributor plate 12 and the solid waste incinerator remains operational. Moreover, since the nozzle shaft 16 and cap 20 are not welded, they are much easier to replace during the annual maintenance of the incinerator. The annular exhaust space 26, FIG. 2 defined between the interior of cap 20 and the outer diameter of shaft 16 is also more easily cleared should fluidized material enter the annular space since hot air traveling up through pipe 10 and within shaft 16 is redirected downward by the interior top surface of cap 20 (as shown by arrow 42, FIG. 2) towards washer 18.

The result, in any embodiment, is a more plug resistant nozzle system which does not require welding of the nozzle end cap 20 or shaft 16 for easier repair and replacement.

This new nozzle system could replace a ¾ inch mushroom nozzle widely used in most of the fluidized bed incinerators. The new nozzle, in fact, has the same open area and the same pressure drop of the mushroom nozzle which has 18 (⅛ inch diameter) holes in the cap.

Preferably cap 20, FIGS. 5-6 has inside skirt 24 three equally spaced supports or stops for shaft 16, which center it and hold the annular width at 0.055+/−0.002 inches. The annular width and the depth of the shaft 16 inside skirt 24 can be varied depending on the fluidizing medium particle size in the bed and the desired pressure drop through the nozzle. "T" rod 30, FIG. 1 can have smaller diameter and the through hole 32, FIGS. 5-6 on cap 20 can be smaller accordingly. The new nozzle system using the proper adapter can replace a ¾ inch mushroom nozzle after cutting the top cap that houses the ⅛ inch diameter holes. Note also that the preferred nozzle system of this invention has no moving parts.

Figure 7:
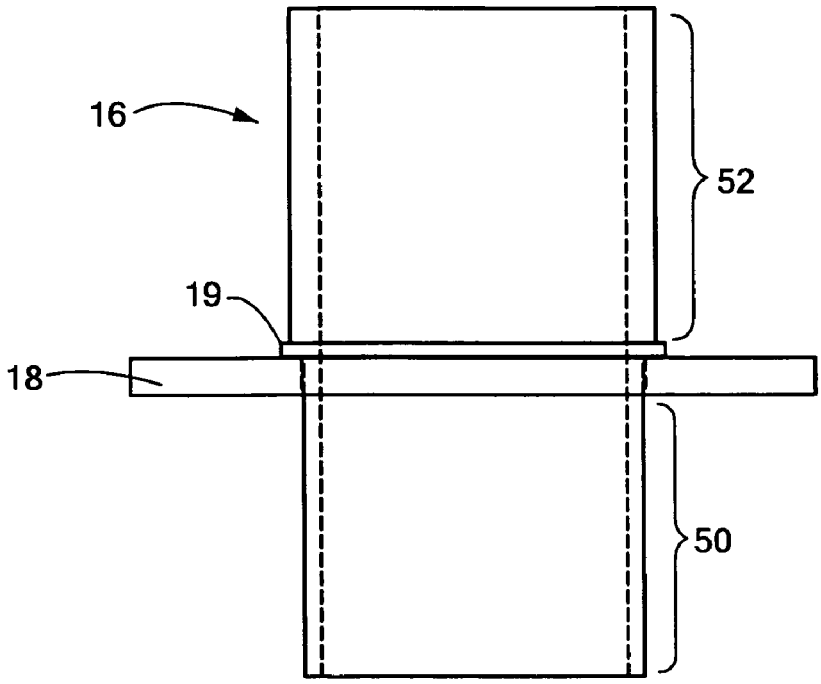
FIG. 7 is a side view of the nozzle system shaft and washer.
Figure 8:
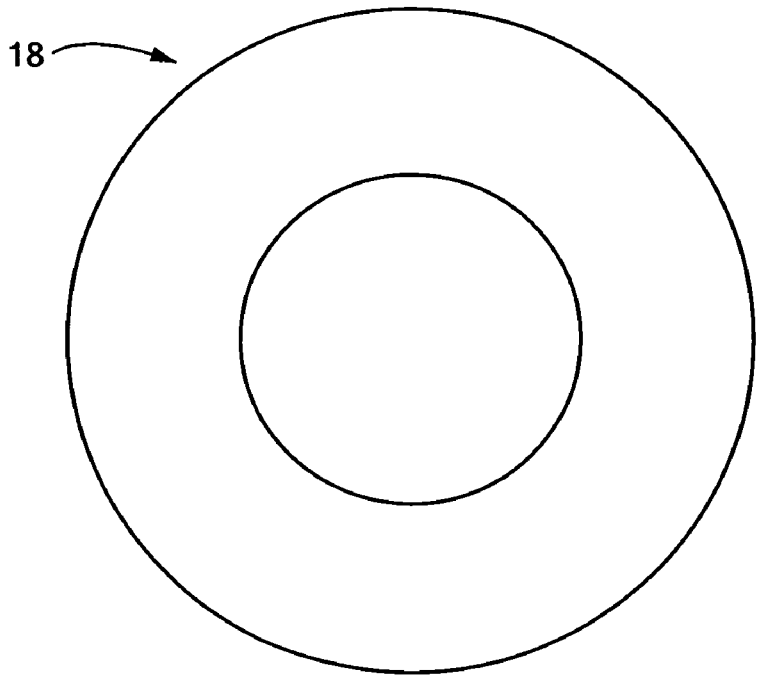
FIG. 8 is a bottom view of the shaft and washer of FIG. 7.

FIG. 7 shows shaft 16, collar 19, and washer 18. Lower portion 50 of shaft 16 has an outer diameter of 1.029 inches and the top portion 52 of shaft 16 is 1.00 inches long and 1.050 inches in diameter. Washer 18 is 0.125 inches thick and has an inner diameter of 1.031 inches. Collar 19 is 0.06 inches thick to 1.0625 inches if the ¾ inch shaft is already 1.050 inches outer diameter, as specified for welded and seamless "standard weight pipe."

Although specific features of the invention are shown in some drawings and not in others, however, this is for convenience only as each feature may be combined with any or all of the other features in accordance with the invention. Also, the words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A nozzle system for a fluidized bed, comprising:

a pipe for insertion through an air distributor plate in the fluidized bed and extending up through a refractory material on the air distributor plate;

a shaft received in the pipe with a stop which supports the shaft on the distal end of the pipe;

a cap including a top surface supported by a solid skirt, the inner diameter of the skirt larger than the outer diameter of the shaft defining a protected annular exhaust space between an outer diameter of the shaft and an inner diameter of the cap skirt defining an exhaust air path from the nozzle system downwardly between the shaft and the cap skirt and under the skirt towards the stop on the shaft, a throat and a depth of the annular space between the outer diameter of the shaft and the inner diameter of the cap skirt establishing a predetermined pressure drop through the nozzle;

spaced discreet supports extending inwardly from the cap skirt supporting the cap on a top of the shaft; and a rod extending within the pipe and the shaft up through an opening in the top surface of the cap, a fastener on the distal end of the rod urged against the top of the cap, and a handle on the proximal end of the rod spanning the proximal end of the pipe.

2. The nozzle system of claim 1 in which inner diameter of the cap steps down between the skirt bottom and the opening.

3. The nozzle system of claim 1 in which the stop includes a washer on a collar which supports the shaft on the distal end of the pipe.

4. The nozzle system of claim 1 in which the handle includes a T-handle on the proximal end of the rod spanning the proximal end of the pipe.

5. The nozzle system of claim 1 in which each of the supports define the throat and the depth of the annular space between the cap skirt and the shaft.

6. The nozzle system of claim 1 in which, if the cap fails, a nut on the rod will burn off and the rod will drop through the air distributor plate.

7. The nozzle system of claim 1 in which the nozzle system does not include any moving parts.

8. The nozzle system of claim 1 in which the supports are machined to fix a throat and a depth of the annular space.

* * * * *